US006880252B1

(12) United States Patent
Drake

(10) Patent No.: US 6,880,252 B1
(45) Date of Patent: Apr. 19, 2005

(54) HAND TOOL FOR DEFINING A STARTING LOCATION FOR AN ELEMENT TO BE DRIVEN INTO A SUBSTRATE

(76) Inventor: Theodore P. Drake, R.R. 1, Box 143A, Sunrise Beach, MO (US) 65079

( * ) Notice: Subject to any disclaimer, the term of this patent is extended or adjusted under 35 U.S.C. 154(b) by 164 days.

(21) Appl. No.: 10/384,844

(22) Filed: Mar. 11, 2003

(51) Int. Cl.[7] ..... B26F 1/00
(52) U.S. Cl. ..... 30/366
(58) Field of Search ..... 30/366–368, 277

(56) References Cited

U.S. PATENT DOCUMENTS

| | | | | |
|---|---|---|---|---|
| 908,921 A | | 1/1909 | Whitcomb | |
| 2,423,511 A | * | 7/1947 | Luben et al. | 33/676 |
| 3,494,431 A | * | 2/1970 | Randolph et al. | 173/202 |
| 3,810,502 A | | 5/1974 | Kyser | |
| 3,884,282 A | | 5/1975 | Dobrosielski | |
| 4,139,036 A | | 2/1979 | Regan et al. | |
| 4,347,450 A | | 8/1982 | Colligan | |
| 4,793,226 A | | 12/1988 | Kress | |
| 5,605,269 A | | 2/1997 | Musiani | |
| 5,914,632 A | | 6/1999 | Fotouhi et al. | |
| 6,198,342 B1 | | 3/2001 | Kawai | |

OTHER PUBLICATIONS

Baker, R. J., et al.; "CMOS, Circuit Design, Layout, and Simulation"; Department of Electrical Engineering, Microelectronics Research Center, The University of Idaho; IEEE Press Series on Microelectronic Systems; IEEE Circuits & Systems Society, Sponsor; IEEE Solid–State Circuits Society, Sponsor; pp. 212–215; 364–371.

* cited by examiner

*Primary Examiner*—Douglas D Watts
(74) *Attorney, Agent, or Firm*—Donald R. Schoonover

(57) ABSTRACT

A hand tool is used to automatically and precisely define a starting hole that will accommodate an element such as a self-tapping screw, a drill bit, or the like. The hand tool has a leading section that automatically orients and locates a punch rod that will be actuated by means of a trigger mechanism to define the starting hole.

2 Claims, 2 Drawing Sheets

HAND TOOL FOR DEFINING A STARTING LOCATION FOR AN ELEMENT TO BE DRIVEN INTO A SUBSTRATE

BACKGROUND OF THE INVENTION

1. Field of the Invention

The present invention relates to the general art of hand tools, and to the particular field of hand tools relating to elements which are driven into a substrate.

2. Discussion of Related Art

Hardware, such as hinges, templates, plates and the like are often mounted on a substrate such as a wall, door, door jamb, window jamb, window blind mounting hardware, cabinet mounting hardware, or the like. The hardware is often mounted using self-tapping screws or like elements. Some such hardware is mounted after a hole has been drilled in a desired location using a drill bit. Often, the hardware is located in difficult-to-reach locations.

Mounting such hardware often requires driving the mounting elements or a drill bit into the substrate using either a hand-powered tool, such as a screwdriver, or a power tool. Often, it requires two hands to drive the mounting element or drill bit into the substrate. One hand must be used to hold the element in place while the other hand is used to provide the power and/or force to actually drive the element into the substrate. This can be awkward, especially if the hardware is located in a difficult-to-reach location.

Therefore, there is a need for an appliance that can be used to facilitate the process of mounting hardware.

One problem with effecting such hardware mounting is associated with the driven element moving away from the desired target area just as force is applied to drive the element into the substrate. This problem can cause hardware to be mounted away from the desired location, or in some instances, actually prevent the hardware from being properly mounted. Skilled craftsmen have learned how to compensate for this problem, but unskilled individuals may have considerable difficulty and experience considerable frustration, due to this problem. Even skilled craftsmen sometimes have difficulty with this problem.

One way of dealing with this problem is to drive a nail or a punch into the substrate at the desired location by using a hammer or other such instrument. This method defines a starter hole or leading hole for the element, but requires two hands which may be difficult or cumbersome in many situations. Even then, the initial leading hole must be properly positioned with respect to the element-accommodating bore in the hardware. Thus, even if it is somewhat convenient to drive a punch into a substrate using a hammer to define the starting location for a hardware-mounting element, the exact location of that leading hole within the mounting element-accommodating bore of the hardware may have to be estimated. A skilled craftsman may be adept at this, but unskilled individuals may have difficulty.

Therefore, there is a need for a hand tool which can easily define a starter location for hardware-mounting elements and which will automatically properly locate that starter location.

Similar problems occur when a hole is to be drilled into a substrate. A drill bit may "walk" away from the desired location as the drill is activated thereby locating the drilled hole in an undesired location. This "walking" problem is generally accounted for by using a starter location as discussed above, but the problems associated with defining such a starter location for a drill bit are similar to those discussed above. Thus, it is to be understood that when reference is made to a mounting element, a drill bit will be included in such a term.

As there are many different types of hardware, any tool that is to be used to mount such hardware should be as versatile as possible. This will allow a user to easily apply the tool to a variety of jobs without requiring special adapter elements or without requiring the user to adapt special procedures.

Therefore, there is a need for a versatile hand tool which is used to define a starter location for hardware-mounting elements.

PRINCIPAL OBJECTS OF THE INVENTION

It is a main object of the present invention to provide a hand tool that can be used to facilitate the process of mounting hardware.

It is another object of the present invention to provide a hand tool which can easily define a starter location for hardware-mounting elements and which will automatically properly locate that starter location.

It is another object of the present invention to provide a versatile hand tool which is used to define a starter location for hardware-mounting elements.

SUMMARY OF THE INVENTION

These, and other, objects are achieved by a hand tool or appliance for defining a starting location for elements which are to be driven into a substrate. The hand tool comprises a housing having a nose section which includes a conical sidewall; a leading section on the nose section of the housing, the leading section having a conical sidewall that is oriented at an oblique angle to the conical sidewall of the nose section of the housing; a punch mechanism movably mounted in the housing to move between a cocked position and a released position; a biasing element on the punch mechanism to bias the punch mechanism toward the released position; a trigger mechanism mounted on the housing and having a sear element movably mounted on the housing to move between a punch mechanism-releasing position and a punch mechanism-cocking position with the punch mechanism being held against the bias of the biasing element when the trigger mechanism is in the punch mechanism-cocking position.

The hand tool or appliance embodying the present invention can be operated by one hand and, due to the double conical or beveled shape on the nose end of the hand tool, will automatically orient itself to define the starter or leader hole in the exact center of a mounting element-accommodating bore on hardware elements, such as hinges or the like. The shape of the leading nose end of the hand tool will have, in one form of the invention, the same degree of angle as the screw hole in a butt hinge that accommodates the angle of a screw head. This will make it easy for a user, even an unskilled user, to accurately define a starter or leader hole for a mounting element, such as a self-tapping screw or the like. The mounting element will then precisely position the hardware in the exact location and position desired. The leading hole will be accurately located so the mounted hardware will not be moved out of a desired position when a mounting element is inserted into the substrate through the mounting element-accommodating holes in the hardware. This will be the case even if the hardware is to be placed in a difficult-to-reach location.

BRIEF DESCRIPTION OF THE DRAWING FIGURES

DETAILED DESCRIPTION OF THE PREFERRED EMBODIMENT

Figure 4:
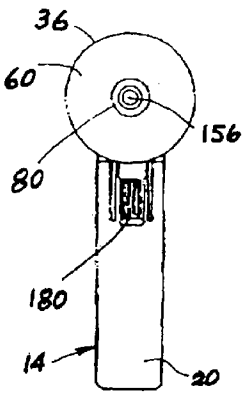
FIG. 4 is an end elevational view of the hand tool embodying the present invention.
Figure 5:
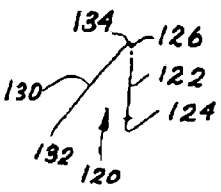
FIG. 5 shows a further enlarged view of a single notch of a plurality of notches used in controlling movement of a punch mechanism of the hand tool embodying the present invention.
Figure 1:
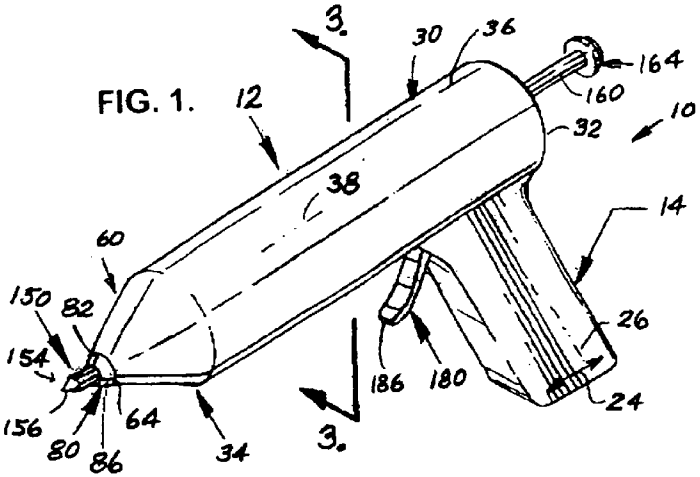
FIG. 1 is a perspective view of a hand tool embodying the present invention in a released configuration.

Other objects, features and advantages of the invention will become apparent from a consideration of the following detailed description and the accompanying drawings.

Referring to the figures, it can be understood that the present invention is embodied in an appliance or hand tool 10 for defining a starting location for elements which are to be driven into a substrate. Appliance 10 comprises a housing 12 having a handle section 14 which includes a first end 16, a second end 18, a first endwall 20, a second endwall 22, a length dimension 24 extending between the first endwall 20 and the second endwall 22, and a height dimension 26 extending between the first end 16 and the second end 18. The handle 14 is manufactured of plastics-type material to be easily, securely and comfortably grasped.

A main section 30 includes a first end 32 located near second end 18 of the handle section 14 and near second endwall 22 of the handle section 14, a second end 34, a sidewall 36 connecting the first end 32 of the main section 30 to the second end 34 of the main section 30 and a longitudinal axis 38 which extends between the first end 32 of the main section 30 and the second end 34 of the main section 30. The sidewall 36 of the main section 30 is connected to the second end 18 of the handle section 14. The main section 30 can also be manufactured of plastics-type materials.

An interior chamber 40 is defined in the main section 30 from adjacent to the first end 32 of the main section 30 to adjacent to the second end 34 of the main section 30. The interior chamber 40 includes a first end 42 located adjacent to first end 32 of the main section 30 and a distal end 44 located near second end 34 of the main section 30 of the housing 12. The distal end 44 of the interior chamber 40 is conical in shape and tapers toward the second end 34 of the main section 30 and has a base end 46 located adjacent to the second end 34 of the main section 30 of the housing 12 and an apex end 48 spaced apart from the base end 46 of the distal end 44 of the interior chamber 40 in the direction of the longitudinal axis 38 of the main section 30 of the housing 12.

A first cutout portion 50 is defined through the sidewall 36 of the main section 30 of the housing 12 adjacent to first endwall 20 of the handle section 14 and adjacent to second end 18 of the handle section 14 of the housing 12. The first cutout portion 50 intersects the interior chamber 40 of the main section 30 of the housing 12.

A second cutout portion 52 is defined in the handle section 14 of the housing 12 through first endwall 20 of the handle section 14 of the housing 12 and adjacent to second end 18 of the handle section 14 of the housing 12. The second cutout portion 52 intersects the first cutout portion 50.

A nose section 60 is on second end 34 of the main section 30 of the housing 12 and includes a proximal end 62 on the second end 34 of the main section 30 of the housing 12 and a distal end 64 spaced apart from the second end 34 of the main section 30 of the housing 12 in the direction of the longitudinal axis 38 of the main section 30 of the housing 12. A conically shaped sidewall 66 has a base 68 at the proximal end 62 of the nose section 60 and an apex portion 70 at the distal end 64 of the nose section 60. Sidewall 66 of the nose section 60 is oriented at a first oblique angle 72 to sidewall 36 of the main section 30 of the housing 12.

A conically shaped leading section 80 is located on apex portion 70 of the nose section 60. Leading section 80 is used to automatically center the hand tool in a mounting element-accommodating bore of an element of hardware. As will be understood from the teaching of this disclosure, the leading section 80 will engage the hardware adjacent to the bore through that hardware as soon as the hand tool is applied to the hardware. The leading section 80 is conical, but is arcuate and thus will move into a bore evenly thereby automatically centering the hand tool with respect to the bore, no matter what size the bore is. Leading section 80 includes a base section 82 on the apex portion 70 of the sidewall 66 of the nose section 60 and an apex section 84 spaced apart from the base section 82 of the leading section 80 in the direction of the longitudinal axis 38 of the main section 30 of the housing 12. Leading section 80 has a conical sidewall 86 which is also arcuate and which connects the base section 82 of the leading section 80 to the apex section 84 of the leading section 80. Sidewall 86 of the leading section 80 is oriented at a second oblique angle 88 to the sidewall 66 of the nose section 60 of the main section 30 of the housing 12.

A first cylindrical bore 90 is defined in the main section 30 of the housing 12 and extends from the apex end 84 of the leading section 80 of the main section 30. Bore 90 extends through the nose section 60 of the main section 30 of the housing 12 and intersects the interior chamber 40 of the main section 30 of the housing 12.

A second bore 92 extends through the first end 32 of the main section 30 of the housing 12 in the direction of the longitudinal axis 38 of the main section 30 of the housing 12. Second cylindrical bore 92 intersects the interior chamber 40 and is axially aligned with the first cylindrical bore 90 and is spaced apart from the first cylindrical bore 90.

A punch mechanism 100 is located in the interior chamber 40 of the main section 30 of the housing 12 and includes a main body 102 which includes a first end 104, a second end 106, and a longitudinal axis 108 which extends between the first end 104 of the main body 102 of the punch mechanism 100 and the second end 106 of the main body 102 of the punch mechanism 100. Longitudinal axis 108 extends in the direction of the longitudinal axis 38 of the main section 30 of the housing 12. A sidewall 110 connects the first 104 end of the main body 102 of the punch mechanism 100 to the second end 106 of the main body 102 of the punch mechanism 100. Sidewall 110 of the main body 102 of the punch mechanism 100 includes a transverse axis 112 which extends across the longitudinal axis 38 of the main section 30 of the housing 12 and which is transverse to the longitudinal axis 108 of the main body 102 of the punch mechanism 100. Second end 106 of the main body 102 of the punch mechanism 100 has a conical shape which corresponds to the conical shape of the distal end 44 of the interior chamber 40 of the main section 30 of the housing 12 and has an apex end 114.

A plurality of notches, such as notch 120, are defined in the main body 102 of the punch mechanism 100. The notches are spaced apart from each other along the direction of the longitudinal axis 108 of the main body 102 of the punch mechanism 100. Each notch of the plurality of notches includes a rear end wall 122 which extends from the sidewall 110 of the main body 102 of the punch mechanism 100 in the direction of the transverse axis 112 of the main body 102 of the punch mechanism 100 and has a first end 124 in the sidewall 110 of the main body 102 of the punch mechanism 100 and a second end 126 located inside the main body 102 of the punch mechanism 100. A sloping front wall 130 has a first end 132 in the sidewall 110 of the main body 102 of the punch mechanism 100. First end 132 of the sloping front wall 130 is spaced apart from the first end 124 of the rear wall 122 of the same notch 120. The sloping front wall 130 extends from the sidewall 110 of the main body 102 of the punch mechanism 100 and has a second end 134 at the second end 126 of the rear wall 122 of the same notch 120.

A punch rod 150 is located in the first cylindrical bore 90 of the main section 30 of the housing 12. Punch rod 150 includes a proximal end 152 attached to the apex end 114 of the second end 106 of the main body 102 of the punch mechanism 100 and a distal end 154 which is conical in shape and has an apex tip 156.

A guide rod 160 extends from first end 104 of the main body 102 through first end 32 of the main section 30 of the housing 12. Guide rod 160 includes a distal end 162 located outside of the interior chamber 40 of the main section 30 of the housing 12. A knob 164 is located on the distal end 162 of the guide rod 160.

A biasing element 170, such as a spring, is located on the guide rod 160 and is located inside the interior chamber 40 of the main section 30 of the housing 12. Biasing element 170 has one end 174 abutting first end 104 of the main body 102 of the punch mechanism 100 and a second end 176 abutting first end 42 of the interior chamber 40 of the main section 30 of the housing 12. Biasing element 170 biases the main body 102 of the punch mechanism 100 toward second end 34 of the main section 30 of the housing 12.

Figure 3:
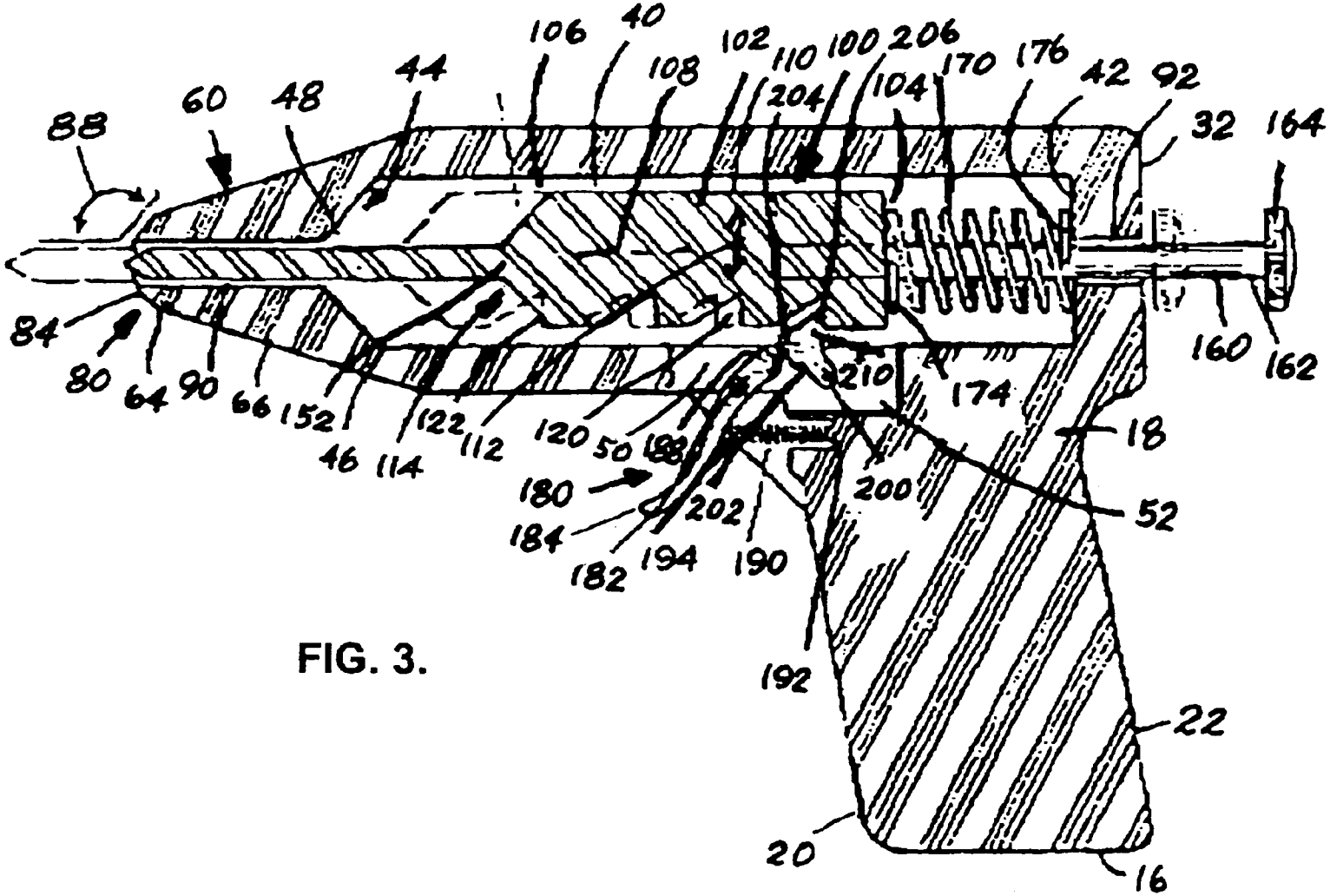
FIG. 3 is an enlarged view taken along line 3—3 of FIG. 1 showing the hand tool of the present invention in a cocked configuration in solid lines, as well as in a released configuration in phantom lines.

Main body 102 of the punch mechanism 100 and punch rod 150 of the punch mechanism 100 and guide rod 160 of the punch mechanism 100 are unitary with each other and are movable in the main section 30 of the housing 12 between a cocked position shown in solid lines in FIG. 3 with apex tip 156 of the punch rod 150 positioned inside first cylindrical bore 90 of the main section 30 of the housing 12 and a released position shown in phantom lines in FIG. 3 with the apex tip 156 of the punch rod 150 of the punch mechanism 100 positioned outside the first cylindrical bore 90 of the main section 30 of the housing 12. Biasing element 170 biases the main body 102 of the punch mechanism 100 toward the released position. Biasing element 170 can include a spiral spring, such as that shown in FIG. 3.

A trigger mechanism 180 is mounted on the housing 12 and controls the release of the punch mechanism 100 from the cocked position thereof to be moved to the released position thereof under the influence of biasing element 170. Trigger mechanism 180 includes a trigger element pivot pin 182 mounted on the main section 30 of the housing 12 and located in the first cutout portion 50 of the main section 30 of the housing 12.

A trigger element 184 is pivotably mounted on the trigger element pivot pin 182 and extends through the first cutout portion 50 of the main section 30 of the housing 12. Trigger element 184 has a first end 186 located outside the interior chamber 40 of the main section 30 of the housing 12 and a second end 188 located inside the interior chamber 40 of the main section 30 of the housing 12.

A trigger element biasing element 190 is mounted on the handle section 14 of the housing 12. Element 190 has a first end 192 which contacts the handle section 14 of the housing 12 and a second end 194 which is connected to the trigger element 184 between the trigger element pivot pin 182 and the first end 186 of the trigger element 184. The trigger element biasing element 190 can be a spring and bias the first end 186 of the trigger element 184 away from the handle section 14 of the housing 12.

A sear element pivot pin 200 is mounted on the main section 30 of the housing 12. A sear element 202 is pivotably mounted on the sear element pivot pin 200 and has one end 204 connected to the second end 188 of the trigger element 184 for movement therewith. A second end 206 of the sear element 202 is located to contact a rear end wall 122 of one notch 120 of the plurality of notches defined in the main body 102 of the punch mechanism 100.

A sear element biasing element 210 can be a spring and is connected to the sear element 202 between the second end 206 of the sear element 202 and the sear element pivot pin 200. The sear element biasing element 210 biases the second end 206 of the sear element 202 toward the first end 32 of the main section 30 of the housing 12 and away from the second end 188 of the trigger element 184.

The trigger element 184 is movable between a cocked configuration in FIG. 3 with the second end 206 of the sear element 202 contacting the rear wall 122 of an associated notch 120 of the plurality of notches defined in the main body 102 of the punch mechanism 100 and holding the main body 102 of the punch mechanism 100 in the cocked position against the bias of the biasing element 170 of the punch mechanism 100 and a released configuration with the second end 206 of the sear element 202 spaced apart from the rear wall 122 of the associated notch 120 of the plurality of notches against the bias of the sear element biasing element 210.

In one form of the hand tool 10, oblique angle 88 between the sidewall 86 of the leading section 80 of the housing 12 and the sidewall 66 of the nose section 60 of the main section 30 of the housing 12 is between 40° and 50°, with the 40° angle being preferred. The leading section 80 has a chamfer or beveled shape that is the same degree of angle as a screw hole in a butt hinge that accommodates the angle of a screw head. This permits accurate center alignment when the screw is installed so as not to move the hinge or mounting hardware out of line when the screw head is seated in the beveled hole of the hinge.

Figure 2:
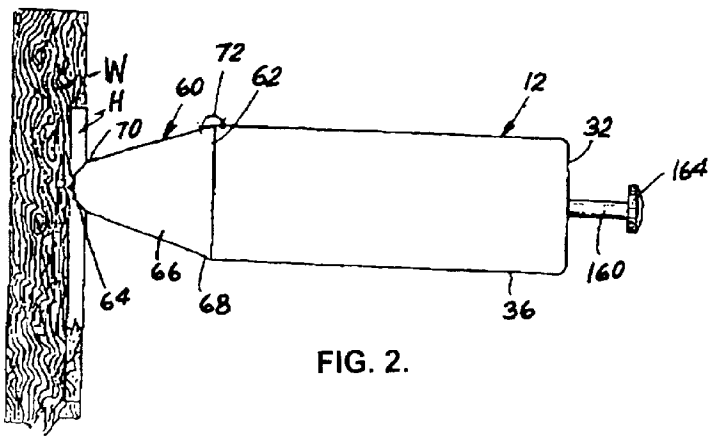
FIG. 2 is a top plan view of the hand tool embodying the present invention in a use position.

Operation of the hand tool 10 is evident from the foregoing, but will be briefly discussed in the interest of complete disclosure. As indicated in the Figures, the hand tool is placed in the cocked position by pulling knob 164 away from the main section 30 of the housing 12 from the phantom line position shown in FIG. 3 to the solid line position shown in FIG. 3. The desired depth of a starter hole can be set by selecting an appropriate one of the notches 120. The trigger mechanism 180 then holds the punch rod 150 in the solid line position shown in FIG. 3. The cocked hand tool 10 is then positioned so the leading section 80 is pressed into the mounting element-accommodating bore of an element of hardware, such as a hinge H, as indicated in FIG. 2. The conical and arcuate shape of that leading section 80 automatically orients the hand tool 10 so the punch rod 150 is accurately centered with respect to the accommodating bore and the thickness of the hardware is accounted for by selecting an appropriate one of the notches 120. The trigger mechanism 180 is operated to release the sear from engagement in a notch 120 and thus to release the main body 102 of the punch mechanism 100, and biasing element 170 forces the punch rod 150 toward the released position shown in phantom lines in FIG. 3. The apex tip 156 engages the substrate, such as wall W and defines a starter hole that will be used to accommodate a mounting element, such as a self-tapping screw or the like. The hand tool 10 is then moved out of the way, and the mounting element can be applied to the substrate using any suitable tool or method. As can be understood from the foregoing, hand tool 10 can be operated with only one hand and can be easily manipulated even in difficult-to-reach places. The outwardly sloping shape of leading section 80 will accommodate bores of various sizes thereby making the hand tool 10 quite versatile.

It is understood that while certain forms of the present invention have been illustrated and described herein, it is not to be limited to the specific forms or arrangements of parts described and shown.

What is claimed is:

1. A hand tool for defining a starting location for elements which are to be driven into a substrate comprising:

a) a housing having (1) a handle section which includes a first end, a second end, a first endwall, a second endwall, a length dimension extending between the first endwall and the second endwall, and a height dimension extending between the first end and the second end, (2) a main section which includes a first end located near the second end of the handle section and near the second endwall of the handle section, a second end, a sidewall connecting the first end of the main section to the second end of the main section, a longitudinal axis extending between the first end of the main section and the second end of the main section, the sidewall of the main section being connected to the second end of the handle section, (3) an interior chamber defined in the main section from adjacent to the first end of the main section to adjacent to the second end of the main section, the interior chamber including a first end located adjacent to the first end of the main section and a distal end located near the second end of the main section of said housing, the distal end of the interior chamber being conical in shape and tapering toward the second end of the main section and having a base end located adjacent to the second end of the main section of said housing and an apex end spaced apart from the base end of the distal end of the interior chamber in the direction of the longitudinal axis of the main section of said housing, (4) a first cutout portion defined through the sidewall of the main section of said housing adjacent to the first endwall of the handle section and adjacent to the second end of the handle portion of said housing, the first cutout portion intersecting the interior chamber of the main section of said housing, (5) a second cutout portion defined in the handle section of said housing through the first endwall of the handle section of said housing and adjacent to the second end of the handle portion of said housing, the second cutout portion intersecting the first cutout portion, (6) a nose section on the second end of the main section of said housing and including a proximal end on the second end of the main section of said housing and a distal end spaced apart from the second end of the main section of said housing in the direction of the longitudinal axis of the main section of said housing, a conically shaped sidewall having a base at the proximal end of the nose section and an apex portion at the distal end of the nose section, the sidewall of the nose section being oriented at a first oblique angle to the sidewall of the main section of said housing, (7) a conically shaped leading section on the apex portion of the nose section, the leading section including a base section on the apex portion of the sidewall of the nose section and an apex section spaced apart from the base section of the leading section in the direction of the longitudinal axis of the main section of said housing, the leading section having a conical and an arcuate sidewall connecting the base section of the leading section to the apex section of the leading section, the sidewall of the leading section being oriented at a second oblique angle to the sidewall of the nose section of the main section of said housing, (8) a first cylindrical bore defined in the main section of said housing and extending from the apex end of the leading section of the main section and extending through the nose section of the main section of said housing, the cylindrical bore intersecting the interior chamber of the main section of said housing, and (9) a second cylindrical bore extending through the first end of the main section of said housing in the direction of the longitudinal axis of the main section of said housing, the second cylindrical bore intersecting the interior chamber and being axially aligned with the first cylindrical bore and spaced apart from the first cylindrical bore;

b) a punch mechanism located in the interior chamber of the main section of said housing and including (1) a main body which includes a first end, a second end, a longitudinal axis extending between the first end of the main body of said punch mechanism and the second end of the main body of said punch mechanism and extending in the direction of the longitudinal axis of the main section of said housing, a sidewall connecting the first end of the main body of said punch mechanism to the second end of the main body of said punch mechanism, the sidewall of the main body of said punch mechanism including a transverse axis extending across the longitudinal axis of the main section of said housing and transverse to the longitudinal axis of the main body of said punch mechanism, the second end of the main body of said punch mechanism having a conical shape which corresponds to the conical shape of the distal end of the interior chamber of the main section of said housing, the second end of the main body of said punch mechanism further including an apex end, (2) a plurality of notches defined in the main body of said punch mechanism, the notches being spaced apart from each other along the direction of the longitudinal axis of the main body of said punch mechanism, each notch of the plurality of notches including a rear end wall extending from the sidewall of the main body of said punch mechanism in the direction of the transverse axis of the main body of said punch mechanism and having a first end in the sidewall of the main body of said punch mechanism and a second end located inside the main body of said punch mechanism, and a sloping front wall having a first end in the sidewall of the main body of said punch mechanism, with the first end of the sloping front wall being spaced apart from the first end of the rear wall of the same notch, the sloping front wall extending from the sidewall of the main body of said punch mechanism and having a second end at the second end of the rear wall of the same notch, (3) a punch rod located in the first cylindrical bore of the main section of said housing and including a proximal end attached to the apex end of the second end of the main body of said punch mechanism and a distal end which is conical in shape and has an apex tip, (4) a guide rod extending from the first end of the main body through the first end of the main section of said housing, the guide rod including a distal end located outside of the interior chamber of the main section of said housing and further including a knob on the distal end of the guide rod, (5) a biasing element on the guide rod and located inside the interior chamber of the main section of said housing, the biasing element having one end abutting the first end of the main body of said punch mechanism and a second end abutting the first end of the interior chamber of the main section of said housing and biasing the main body of said punch mechanism toward the second end of the main section of said housing, and (6) the main body of said punch mechanism and the punch rod of said punch mechanism and the guide rod of said punch mechanism being unitary with each other and being movable in the main section of said housing between a cocked position with the apex tip of the punch rod positioned inside the first cylindrical bore of the main section of said housing and a released position with the apex tip of the punch rod of said punch mechanism positioned outside the first cylindrical bore of the main section of said housing, the biasing element biasing the main body of said punch mechanism toward the released position; and c) a trigger mechanism mounted on said housing and including (1) a trigger element pivot pin mounted on the main section of said housing and located in the first cutout portion of the main section of said housing, (2) a trigger element pivotably mounted on the trigger element pivot pin and extending through the first cutout portion of the main section of said housing and having a first end located outside the interior chamber of the main section of said housing and a second end located inside the interior chamber of the main section of said housing, (3) a trigger element biasing element mounted on the handle section of said housing and having a first end contacting the handle section of said housing and a second end connected to the trigger element between the trigger element pivot pin and the first end of the trigger element, the trigger element biasing element biasing the first end of the trigger element away from the handle section of said housing, (4) a sear element pivot pin mounted on the main section of said housing, (5) a sear element pivotably mounted on the sear element pivot pin and having one end connected to the second end of the trigger element for movement therewith, and a second end located to contact a rear end wall of one notch of the plurality of notches defined in the main body of said punch mechanism, (6) a sear element biasing element connected to the sear element between the second end of the sear element and the sear element pivot pin, the sear element biasing element biasing the second end of the sear element toward the first end of the main section of said housing and away from the second end of the trigger element, and (7) the trigger element being movable between a cocked configuration with the second end of the sear element contacting the rear wall of an associated notch of the plurality of notches defined in the main body of said punch mechanism and holding the main body of said punch mechanism in the cocked position against the bias of the biasing element of said punch mechanism and a released configuration with the second end of the sear element spaced apart from the rear wall of the associated notch of the plurality of notches against the bias of the sear element biasing element.

2. The hand tool as described in claim 1 wherein the oblique angle between the sidewall of the leading section of said housing and the sidewall of the nose section of the main section of said housing is between 40° and 50°.

* * * * *